US006425962B1

(12) United States Patent
Kawamata et al.

(10) Patent No.: US 6,425,962 B1
(45) Date of Patent: Jul. 30, 2002

(54) NON-ORIENTED ELECTRICAL STEEL SHEET EXCELLENT IN PERMEABILITY AND METHOD OF PRODUCING THE SAME

(75) Inventors: Ryutaro Kawamata, Futtsu; Yoshihiro Arita, Kitakyushu; Shinichi Kanao, Kitakyushu; Kazufumi Hanzawa, Kitakyushu; Takeshi Kubota, Futtsu; Kenichi Murakami, Kitakyushu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/548,699

(22) Filed: Apr. 13, 2000

(30) Foreign Application Priority Data

Oct. 13, 1999 (JP) ..... 11-290900

(51) Int. Cl.[7] ..... H01F 1/147
(52) U.S. Cl. ..... 148/307; 148/306
(58) Field of Search ..... 148/306, 307; 420/103

(56) References Cited

U.S. PATENT DOCUMENTS 4,204,890 A * 5/1980 Irie et al. ..... 148/111
4,293,336 A * 10/1981 Matsumura et al.
4,946,519 A * 8/1990 Honda et al. ..... 148/307
5,045,129 A * 9/1991 Barisoni et al. ..... 148/111
5,676,770 A * 10/1997 Sato et al. ..... 148/307

FOREIGN PATENT DOCUMENTS

| | | |
|---|---|---|
| JP | 6-220537 | 8/1994 |
| JP | 8-109449 | 4/1998 |

OTHER PUBLICATIONS

Kubota, T., and Nagai, T., "Magnetic Properties of HighEfficiency Core Materials NC–M3 and NC–M4", *Journal of Materials Engineering and Performance*, vol. 1(2), Apr. 1992, pp. 219–225.

Office Action dated Feb. 13, 2002 of Japanese Patent Office in counterpart Japanese Patent Application No. 2000–182045 along with partial English language translation.

* cited by examiner

*Primary Examiner*—John Sheehan
(74) *Attorney, Agent, or Firm*—Kenyon & Kenyon

(57) ABSTRACT

A non-oriented electrical steel sheet excellent in permeability whose steel contains, in percentage by weight, $0.1\% \leqq Si \leqq 1.0\%$, $0.1\% \leqq Mn \leqq 0.8\%$, $0.1\% \leqq Al \leqq 1.0\%$ and the balance of Fe and unavoidable impurities, and which has an ay transformation, an electrical resistivity of not less than $10\times10^{-8}$ Ωm and not greater than $32\times10^{-8}$ Ωm and a permeability $\mu^{15}$‰ of not less than 1500 (Gauss/Oe); and a method of producing the same.

3 Claims, No Drawings

NON-ORIENTED ELECTRICAL STEEL SHEET EXCELLENT IN PERMEABILITY AND METHOD OF PRODUCING THE SAME

BACKGROUND OF THE INVENTION

1. Field of the Invention

The present invention relates to a non-oriented electrical steel sheet having a high permeability and excellent electrical properties that is usable as iron core material of electrical, equipment and to a method of producing the non-oriented electrical steel sheet.

2. Description of the Related Art

Against a backdrop of worldwide moves to protect the global environment by conserving electric power and other forms of energy, restricting use of Freon gas and other measures, there has arisen a rapidly spreading drive to enhance the efficiency of electrical equipment, particularly in the rotating machine, small transformer and other sectors that use non-oriented electrical steel sheet as a material for magnetic iron cores. This has also made non-oriented electrical steel sheet a target of calls for property improvement, i.e., demands for non-oriented electrical steel sheets with high magnetic permeability.

Conventionally, the effort to lower the core loss of non-oriented electrical steel sheet has generally relied on the method of increasing the content of Si or of Al or the like. This is based on the principle that increasing electrical resistance reduces eddy-current loss. This method has the disadvantage that it inevitably lowers permeability. To overcome this problem, the method of coarsening the crystal grain diameter of the hot-rolled sheet to enhance both permeability and core loss property is used.

On the other hand, in non-oriented electrical steel sheet that has a transformation, one conventional practice has been to terminate hot-rolling near the upper limit of the a region, thereby securing the required crystal grain diameter before cold rolling and, as a result, elevating the permeability of the product. It is from this standpoint that Japanese Unexamined Patent Publication No. 56(1981)-38420 teaches a method for increasing coarseness of the hot-rolled crystalline texture by finishing hot-rolling at a temperature at or below a temperature midway between the $Ar_3$ point and the $Ar_1$ point and carrying out coiling at a temperature of 680° C. or higher. The improvement in the permeability of a non-oriented electrical steel sheet that can be achieved solely by controlling the hot-rolling conditions is, however, limited.

As methods for enhancing the permeability of non-oriented electrical steel sheet by improving the primary recrystallized texture, Japanese Unexamined Patent Publication No. 55(1980)-158252 teaches Sn addition, Japanese Unexamined Patent Publication No. 62(1987)-180014 teaches addition of Sn and Cu and Japanese Unexamined Patent Publication No. 59(1984)-100217 teaches addition of Sb as methods for enhancing crystalline texture so as to produce non-oriented electrical steel sheet excellent in electrical properties. The expense of adding a crystalline texture controlling element such as Sn, Cu or Sb is, however, by no means negligible. It has therefore been difficult to provide a non-oriented electrical steel sheet at low cost.

Measures implemented during the production process, such as innovations to the finish annealing cycle as taught by Japanese Unexamined Patent Publication No. 57(1982)-35626, have achieved core loss reduction but have not had much effect toward improving permeability.

SUMMARY OF THE INVENTION

The inventors conducted an in-depth analysis in search of means for overcoming the aforesaid limitations of the prior art. Through this study they discovered that a non-oriented electrical steel sheet excellent in both permeability and core loss can be produced using a low-alloy composition system, effecting controlled hot rolling, and controlling the electrical resistivity of the steel to within a definite range.

One object of the present invention is to overcome the problems of the prior art by providing a non-oriented electrical steel sheet excellent in permeability and a method of producing the non-oriented electrical steel sheet.

The gist of the present invention is as follows:

(1) A non-oriented electrical steel sheet excellent in permeability whose steel contains, in percentage by weight, $0.1\% \leqq Si \leqq 1.0\%$ $0.1\% \leqq Mn \leqq 0.8\%$ $0.4\% \leqq Al \leqq 1.0\%$, and the balance of Fe and unavoidable impurities, and which has an ay transformation, an electrical resistivity of not less than $10\times10^{-8}$ Ωm and not greater than $32\times10^{-8}$ Ωm, and a permeability $\mu15/60$ of not less than 1500 (Gauss/Oe).

(2) A hot-rolled sheet for a non-oriented electrical steel sheet whose steel contains, in percentage by weight, $0.1\% \leqq Si \leqq 1.0\%$ $0.1\% \leqq Mn \leqq 0.8\%$ $0.4\% \leqq Al \leqq 1.0\%$, and the balance of Fe and unavoidable impurities, and which has an ay transformation, an electrical resistivity of not less than $10\times10^{-8}$ Ωm and not greater than $32\times10^{-8}$ Ωm, a recrystallized texture of a grain diameter viewed in a hot-rolled sheet cross-section of not less than 5 μm and less than 50 μm, and a worked texture of an area ratio viewed in a hot-rolled sheet cross-section of not greater than 80%.

(3) A hot-rolled sheet for a non-oriented electrical steel sheet whose steel contains, in percentage by weight, $0.1\% \leqq Si \leqq 1.0\%$ $0.1\% \leqq Mn \leqq 0.8\%$ $0.4\% \leqq Al \leqq 1.0\%$, and the balance of Fe and unavoidable impurities, and which has an ay transformation, an electrical resistivity of not less than $10\times10^{-8}$ Ωm and not greater than $32\times10^{-8}$ Ωm, and a crystal grain diameter of not less than 50 μm and not greater than 500 μm.

(4) A method of producing a non-oriented electrical steel sheet excellent in permeability comprising the steps of subjecting a steel containing, in percentage by weight, $0.1\% \leqq Si—1.0\%$ $0.1\% \leqq Mn \leqq 0.8\%$ $0.4\% \leqq Al \leqq 1.0\%$, and the balance of Fe and unavoidable impurities, and having an at transformation and an electrical resistivity of not less than $10\times10^{-8}$ Ωm and not greater than $32\times10^{-8}$ Ωm to hot rolling at a hot-rolling finishing temperature in finish hot rolling of not less than 850° C. and not greater than 1050° C. and also not greater than $(Ar_3+Ar_1)/2$.

DESCRIPTION OF THE PREFERRED EMBODIMENTS

The present invention will now be explained in detail.

The inventors conducted an intensive study to overcome the drawbacks of the prior art and enable simultaneous achievement of low core loss and high flux density. As a result, they discovered that, in the case of a non-oriented electrical steel sheet having a transformation, when a steel containing 0.1%–1.0% of Si, 0.4%–1.0% of Al and 0.1%–0.8% of Mn is designed in composition to have an αλ transformation, the result is subjected to controlled hot rolling under specified conditions to form a distinctive hot-rolled texture, and the hot-rolled sheet is used as a starting material, a non-oriented electrical steel sheet excellent in both permeability and core loss property can be produced.

The conventional method used to improve the permeability of a non-oriented electrical steel sheet has been to coarsen the crystalline texture before cold rolling. In research leading to the present invention, the inventors confirmed that an additional improvement in permeability, can be obtained by conducting hot-rolled sheet annealing to coarsen the crystalline texture before cold rolling but they further discovered that non-oriented electrical steel sheet with permeability comparable to that of a material subjected to hot-rolled sheet annealing can be obtained by the present invention even if hot-rolled annealing is not conducted.

The steel composition will be explained first. Silicon (Si) is added to increase the specific resistance of the steel sheet and thereby lower eddy-current loss and improve core loss value. Si must be added to a content of not less than 0.1% because sufficient specific resistance cannot be obtained at less than 0.1%. The Si content is further limited to not greater than 1.0% because permeability decreases at a content in excess of 1%.

Manganese (Mn), like Si, also works to lower eddy-current loss by increasing the specific resistance of the steel sheet. A Mn content of not less than 0.1% is needed to obtain this effect. The Mn content is further limited to not greater than 0.8% because permeability decreases at a content in excess of 0.8%.

Aluminum (Al), like Si, also works to lower eddy-current loss by increasing the specific resistance of the steel sheet. Not less than 0.4% is preferably added particularly when low core loss is desired. An Al content of not less than 0.6% is preferable for elevating permeability and boosting electrical resistivity. The Al content is further limited to not greater than 1.0% because permeability decreases at a content in excess of 1.0%.

The electrical resistivity of the steel is defined as not less than $10\times10^{-8}$ Ωm because core loss property declines at an electrical resistivity of less than $10\times10^{-8}$ Ωm. The electrical resistivity is defined as not greater than $32\times10^{-8}$ Ωm because permeability declines at an electrical resistivity of greater than $32\times10^{-8}$ Ωm.

One or more of P, B, Ni, Sn, Cu and Sb can be incorporated in the steel in order to improve the mechanical properties, magnetic properties or anti-rust property of the product or for any of various other purposes. Addition of these elements does not detract from the effect of the present invention.

Carbon (C) content must be controlled to not more than 0.004%. When the C content exceeds 0.004%, the core loss property is degraded by magnetic aging during product use and, in addition, carbides produced by reaction with impurity elements inhibit crystal grain growth during finish annealing, and this also degrades core loss property. The C content, therefore, has to be limited to not more than 0.004%.

Sulfur (S) and nitrogen (N) partially reenter solid solution during slab heating in the hot rolling step. This results in formation of sulfides such as MnS and nitrides such as AlN during hot rolling. As these compounds inhibit grain growth during recrystallization annealing, the S and N contents are both preferably limited to not greater than 0.003%.

Phosphorous (P) improves the punching property of the product and is therefore added up to 0.1%. So long as $P\leqq0.2\%$, no problem arises from the viewpoint of product magnetic properties.

The process conditions of the present invention will now be explained.

Since the steel of the present invention has ay transformation, its hot-rolling deformation resistance tends to fluctuate when the hot-rolling finishing temperature during hot rolling exceeds $(Ar_3+Ar_1)/2$. As this makes it impossible to obtain a hot-rolled steel sheet excellent in sheet thickness accuracy, the hot-rolling finishing temperature is therefore defined as not greater than $(Ar_3+Ar_1)/2$. When the hot-rolling finishing temperature exceeds 1050° C., coiling at a temperature of 650° C. or lower becomes difficult. The upper limit of the hot-rolling finishing temperature is therefore set at 1050° C. and also set at $(Ar_3+Ar_1)/2$. When the hot-rolling finishing temperature is less than 850° C., rolling becomes difficult owing to increased hot-rolling deformation resistance. The lower limit is therefore set at 850° C.

A steel slab having the composition set out above is produced by converter refinement and continuous casting or ingotting-blooming. The steel slab is heated by a known method. The heated slab is hot rolled to a prescribed thickness.

The average grain diameter of the recrystallized texture viewed in a cross-section of the hot-rolled sheet must be not less than 5 μm and not greater than 50 μm and the area ratio of the worked texture viewed in a cross-section taken in the rolling direction of the hot-rolled sheet cross-section must be not greater than 80%. When the grain diameter of the hot-rolled sheet is less than 5 μm, the high permeability aimed at by the present invention cannot be obtained. The grain diameter of the recrystallization grains of the hot-rolled sheet is therefore defined as not less than 5 μm. When the grain diameter exceeds 50 μm, a high permeability cannot be obtained in copresence with the worked texture. The upper limit is therefore set at 50 μm.

In the present invention, the area ratio of the worked texture viewed in a cross-section taken in the rolling direction of the hot-rolled sheet cross-section must be not greater than 80%.

When this hot-rolled sheet is used, an excellent permeability $\mu^{15}/_{60}$ of not less than 1500 Gauss/Oe can be obtained by a single cold rolling and annealing.

When the area ratio of the worked texture exceeds 80%, the surface condition of the product is degraded by occurrence of ridging after rolling. The area ratio is therefore defined as not greater than 80%. In the case of the hot-rolled sheet having the composition defined by the present invention, a high permeability is easier to obtain when some worked texture remains.

"Worked texture", as used with respect to the present invention, refers to both portions of the texture having dislocations present at high density and exhibiting dark color by etching and elongated grains produced by rolling. "Recrystallized texture", as used with respect to the present invention, means texture composed of isometric crystals.

The hot-rolled sheet can be subjected to hot-rolled sheet annealing to coarsen the crystalline texture before cold rolling. At this time, the grain diameter of the hot-rolled sheet must be not less than 50 μm and not greater than 500 μm. When the grain diameter of the hot-rolled crystalline texture after hot-rolled sheet annealing is less than 50 μm, the hot-rolled sheet annealing produces no effect. A grain diameter of not less than 50 μm is therefore required. When the grain diameter of the hot-rolled crystalline texture after hot-rolled sheet annealing is greater than 500 μm, the surface condition of the steel sheet after cold rolling becomes inferior. The upper limit of the grain diameter is therefore defined as not greater than 500 μm.

In order to prevent grain refinement by transformation, the hot-rolled sheet annealing is preferably conducted at a temperature not greater than the $Ac_1$ point.

"Permeability $\mu^{15}/_{60}$", as used with respect to the present invention, is the value obtained by measuring the permeability at an excitation flux density of 1.5 Tesla and a frequency of 60 Hz in Gauss as the flux density unit and Oe as the excitation magnetic field intensity and dividing the flux density by the excitation magnetic field intensity.

Examples of the present invention will now be described.

EXAMPLE 1

Slabs of the compositions shown in Table 1 were used to produce non-oriented electrical steel sheets. Each slab was heated by an ordinary method and hot rolled to a final thickness of 2.5 mm. The hot-rolled sheet was then cold rolled to a final thickness of 0.5 mm and annealed in a continuous annealing furnace at 730° C. for 30 seconds. An Epstein sample was cut from the annealed sheet and subjected to electrical property measurement. Table 1 shows the compositions and measured permeabilities of the invention examples and the comparative examples.

It can be seen that a non-oriented electrical steel sheet exhibiting high permeability and excellent electrical properties can be obtained by use of a steel whose composition falls within the ranges defined by the present invention.

TABLE 1

| | C (%) | Si (%) | Mn (%) | P (%) | S (%) | Al (%) | N (%) | Electrical resistivity Ωm | $\mu$15/60 (Gauss/Oe) |
|---|---|---|---|---|---|---|---|---|---|
| Invention 1 | 0.0011 | 0.70 | 0.50 | 0.050 | 0.0009 | 0.60 | 0.0008 | $28.5 \times 10^{-8}$ | 1560 |
| Invention 2 | 0.0014 | 0.80 | 0.45 | 0.050 | 0.0010 | 0.70 | 0.0009 | $30.8 \times 10^{-8}$ | 1600 |
| Comparison 1 | 0.0038 | 0.50 | 0.40 | 0.050 | 0.0010 | 1.20 | 0.0010 | $33.7 \times 10^{-8}$ | 1310 |
| Comparison 2 | 0.0009 | 1.25 | 0.35 | 0.050 | 0.0015 | 0.70 | 0.0009 | $35.4 \times 10^{-8}$ | 1250 |

EXAMPLE 2

Slabs of the compositions shown in Table 2 were used to produce non-oriented electrical steel sheets. Each slab was heated by an ordinary method and hot rolled to a final thickness of 2.5 mm.

The hot-rolled sheet was then pickled and cold rolled to a final thickness of 0.50 mm. The cold-rolled sheet was annealed in a continuous annealing furnace at 730° C. for 30 seconds. An Epstein sample was cut from the annealed sheet, subjected to user-level annealing at 750° C. for 2 hours, and then subjected to electrical property measurement.

Table 3 shows the hot-rolled sheet annealing temperatures and measured electrical properties of the invention examples and the comparative examples. The comparative examples experienced ridging and were unsuitable for use owing to marked surface condition degradation.

TABLE 2

| C (%) | Si (%) | Mn (%) | P (%) | S (%) | Al (%) | N (%) | Electrical resistivity Ωm |
|---|---|---|---|---|---|---|---|
| 0.0011 | 0.75 | 0.50 | 0.010 | 0.0010 | 0.60 | 0.0011 | $29.1 \times 10^{-8}$ |

TABLE 3

| | Worked texture area ratio of hot-rolled crystalline texture (%) | Grain diameter of hot-rolled recrystallized texture ($\mu$m) | Electrical properties $\mu$15/60 (Gauss/Oe) | Remark |
|---|---|---|---|---|
| Invention | 0.01 | 35 | 1650 | |
| Invention | 0.50 | 30 | 1600 | |
| Invention | 20.0 | 25 | 1550 | |
| Comparative | 90.0 | 30 | 1640 | Ridging |

It can be seen that a steel sheet exhibiting high permeability can be produced by use of a hot-rolled sheet having at least a prescribed amount of worked texture.

EXAMPLE 3

Slabs of the compositions shown in Table 2 were used to produce non-oriented electrical steel sheets. Each slab was heated by an ordinary method and hot rolled to a final thickness of 2.5 mm.

The hot-rolled sheet was then pickled and cold rolled to a final thickness of 0.50 mm using bright rolls. The cold-rolled sheet was annealed in a continuous annealing furnace at 730° C. for 30 seconds. An Epstein sample was cut from the annealed sheet, subjected to user-level annealing at 750° C. for 2 hours, and then subjected to electrical property measurement.

Table 4 shows the hot-rolled sheet annealing temperatures and measured electrical properties of the invention examples and the comparative examples. The comparative examples were high in permeability but experienced ridging and were unsuitable for use owing to marked surface condition degradation.

TABLE 4

| | Worked texture area ratio of hot-rolled crystalline texture (%) | Grain diameter of hot rolled recrystallized texture ($\mu$m) | Electrical properties $\mu$15/60 (Gauss/Oe) | Remark |
|---|---|---|---|---|
| Invention | 0.02 | 36 | 2100 | |
| Invention | 0.45 | 32 | 2090 | |
| Invention | 22.0 | 27 | 2150 | |
| Comparative | 88.0 | 29 | 2050 | Ridging |

It can be seen that a steel sheet exhibiting high permeability can be produced by use of a hot-rolled sheet having at least a prescribed amount of worked texture.

EXAMPLE 4

Slabs of the compositions shown in Table 5 were used to produce non-oriented electrical steel sheets. Each slab was heated by an ordinary method and hot rolled to a final thickness of 2.3 mm. The hot-rolled sheet were annealed at a temperature not greater than the $Ac^1$ point of 950° C. The annealing time was varied to obtain different grain diameters before cold rolling. The hot-rolled sheet was then pickled and cold rolled to a final thickness of 0.50 mm using bright rolls. Part of the cold-rolled sheet was used to produce full-processed sheet and part to produce semi-processed sheet. The full-processed sheet was obtained by annealing the cold-rolled sheet in a continuous annealing furnace at 730° C. for 30 seconds and then subjecting it to user-level annealing at 750° C. for 2 hours. The semi-process steel sheet was obtained by annealing the cold-rolled sheet in a continuous annealing furnace at 700° C. for 20 seconds, and finishing it to a final thickness of 0.47 mm by skin-pass rolling. An Epstein sample was cut from each semi-processed sheet, subjected to user-level annealing at 750° C. for 2 hours, and then subjected to electrical property measurement.

Tables 6 and 7 show the measured electrical properties of the invention examples and the comparative examples. The comparative examples were unsuitable for use owing to marked degradation of surface condition by the rolling.

It can be seen that a non-oriented electrical steel sheet with a high permeability value can be produced by effecting hot-rolled sheet annealing to obtain an appropriate grain diameter.

EXAMPLE 5

Slabs of the composition shown in Table 5 were used to produce non-oriented electrical steel sheets. Each slab was heated by an ordinary method and hot rolled to a final thickness of 2.3 mm. The hot-rolled sheets were annealed at a temperature not greater than the Ac1 point of 950° C. The annealing time was varied to obtain different grain diameters before cold rolling.

Each annealed sheet was then pickled and cold rolled to a final thickness of 0.50 mm using dull rolls. The cold-rolled sheets were annealed in a continuous annealing furnace at 700° C. for 20 seconds and finished to a final thickness of 0.47 mm by skin-pass rolling. An Epstein sample was cut from each sheet, subjected to user-level annealing at 750° C. for 2 hours, and then subjected to electrical property measurement.

Table 8 shows the hot-rolled sheet annealing temperatures and measured electrical properties of the invention examples and the comparative examples. The comparative examples were unsuitable for use owing to marked degradation of surface condition by the rolling.

TABLE 5

| C (%) | Si (%) | Mn (%) | P (%) | S (%) | Al (%) | N (%) | Ti (%) | Electrical resistivity Ωm |
|---|---|---|---|---|---|---|---|---|
| 0.0016 | 0.75 | 0.55 | 0.010 | 0.0010 | 0.65 | 0.0010 | 0.0010 | $30.0 \times 10^{-8}$ |

TABLE 6

| Full-processed sheet | Grain diameter of texture before cold rolling (μm) | Magnetic properties μ15/60 (Gauss/Oe) | Remark |
|---|---|---|---|
| Invention | 60 | 2300 | |
| Invention | 80 | 2290 | |
| Invention | 150 | 2350 | |
| Comparative | 600 | 2250 | Degraded surface condition |

TABLE 7

| Semi-processed sheet | Grain diameter of texture before cold rolling (μm) | Magnetic properties μ15/60 (Gauss/Oe) | Remark |
|---|---|---|---|
| Invention | 60 | 2400 | |
| Invention | 80 | 2350 | |
| Invention | 150 | 2550 | |
| Comparative | 600 | 2450 | Degraded surface condition |

TABLE 8

| Full-processed sheet | Grain diameter of texture before cold rolling (μm) | Magnetic properties μ15/60 (Gauss/Oe) | Remark |
|---|---|---|---|
| Invention | 75 | 1650 | |
| Invention | 140 | 1700 | |
| Invention | 250 | 1800 | |
| Comparative | 620 | 1790 | Degraded surface condition |

It can be seen that a non-oriented electrical steel sheet with a high permeability value can be produced by effecting hot-rolled sheet annealing to obtain an appropriate grain diameter.

As set out in the foregoing, the present invention thus enables production of a non-oriented electrical steel sheet exhibiting high permeability and excellent electrical properties.

What is claimed is:

1. A non-oriented electrical steel sheet excellent in permeability, said steel containing, in percentage by weight, $0.1\% \leqq Si \leqq 1.0\%$ $0.1\% \leqq Mn \leqq 0.8\%$ $0.60\% \leqq Al \leqq 1.0\%$, and the balance of Fe and unavoidable impurities, and which has an αλ transformation, an electrical resistivity of not less than $10 \times 10^{-8}$ Ωm and not greater than $32 \times 10^{-8}$ Ωm, and a permeability $\mu^{15}/_{60}$ of not less than 1500 (Gauss/Oe).

2. A hot-rolled steel sheet for a non-oriented electrical steel sheet, said steel containing, in percentage by weight, $0.1\% \leqq Si \leqq 1.0\%$ $0.1\% \leqq Mn \leqq 0.8\%$ $0.60\% \leqq Al \leqq 1.0\%$, and the balance of Fe and unavoidable impurities, and which has an $\alpha\lambda$ transformation, an electrical resistivity of not less than $10\times10^{-8}$ Ωm and not greater than $32\times10^{-8}$ Ωm, said hot-rolled steel sheet having after recrystallization a recrystallized texture of a grain diameter viewed in a hot-rolled sheet cross-section of not less than 5 μm and less than 50 μm, and said hot-rolled steel sheet having after deformation by hot-rolling and prior to recrystallization a worked texture of an area ratio viewed in a hot-rolled sheet cross-section of not greater than 80%.

3. A hot-rolled steel sheet for a non-oriented electrical steel sheet, said steel containing, in percentage by weight, $0.1\% \leqq Si \leqq 1.0\%$ $0.1 \leqq Mn \leqq 0.8\%$ $0.60\% \leqq Al \leqq 1.0\%$, and the balance of Fe and unavoidable impurities, and which has an $\alpha\lambda$ transformation, an electrical resistivity of not less than $10\times10^{-8}$ Ωm and not greater than $32\times10^{-8}$ Ωm, and a crystal grain diameter of not less than 50 μm and not greater than 500 μm.

* * * * *

UNITED STATES PATENT AND TRADEMARK OFFICE

CERTIFICATE OF CORRECTION

PATENT NO. : 6,425,962 B1
DATED : July 30, 2002
INVENTOR(S) : Ryutaro Kawamata et al.

It is certified that error appears in the above-identified patent and that said Letters Patent is hereby corrected as shown below:

Title page,
Item [57], ABSTRACT,
Line 5, change "...ay…" to -- ...αγ... --.

Column 2,
Lines 28 and 41, change "...ay…" to -- ...αγ... --.

Column4,
Line 3, change "...ay…" to -- ...αγ... --.

Column 8,
Line 65, change "...αλ..." to -- ...αγ... --.

Column 9,
Line 7, change "...αλ..." to -- ...αγ... --.

Column 10,
Line 9, change "...αλ..." to -- ...αγ... --.

Signed and Sealed this

Twenty-seventh Day of July, 2004

JON W. DUDAS
*Acting Director of the United States Patent and Trademark Office*